US009793588B2

(12) United States Patent
Kawamura et al.

(10) Patent No.: US 9,793,588 B2
(45) Date of Patent: Oct. 17, 2017

(54) WAVEGUIDE SWITCH

(71) Applicant: ANRITSU CORPORATION, Kanagawa (JP)

(72) Inventors: Takashi Kawamura, Kanagawa (JP); Akihito Otani, Kanagawa (JP)

(73) Assignee: ANRITSU CORPORATION, Kanagawa (JP)

( * ) Notice: Subject to any disclaimer, the term of this patent is extended or adjusted under 35 U.S.C. 154(b) by 56 days.

(21) Appl. No.: 14/965,491

(22) Filed: Dec. 10, 2015

(65) Prior Publication Data

US 2016/0172731 A1 Jun. 16, 2016

(30) Foreign Application Priority Data

Dec. 12, 2014 (JP) ..... 2014-251710

(51) Int. Cl.
*H01P 1/10* (2006.01)
*H01P 1/12* (2006.01)
*H01P 5/00* (2006.01)

(52) U.S. Cl.
CPC ..... *H01P 1/10* (2013.01); *H01P 1/122* (2013.01)

(58) Field of Classification Search
CPC ..... H01P 1/10; H01P 1/122; H01P 5/10
USPC ..... 333/108
See application file for complete search history.

(56) References Cited

U.S. PATENT DOCUMENTS 4,242,652 A * 12/1980 Shishido ..... H01P 1/122 333/106
6,218,912 B1 * 4/2001 Mayer ..... H01P 1/122 333/106
7,330,087 B2 * 2/2008 Gorovoy ..... H01P 1/122 333/106
9,373,452 B2 * 6/2016 Warwick ..... H01H 45/02
2014/0266498 A1 * 9/2014 Tsounis ..... H01P 1/122 333/108

FOREIGN PATENT DOCUMENTS

JP H05-055802 A 5/1993

* cited by examiner

*Primary Examiner* — Dean Takaoka
(74) *Attorney, Agent, or Firm* — Pearne & Gordon LLP

(57) ABSTRACT

A movable waveguide block 50 having transmission lines 51 and 52 slides in a non-contact manner between a first end surface 30*b* of a first fixing waveguide block 30 having transmission lines 31 and 32 and a second end surface 40*a* of a second fixing waveguide block 40 having a transmission line 41, and switching of propagation paths is performed. Grooves 35A, 35B, 36A, 36B, 45A, 45B, 55A, 55B, 56A, 56B, 57A, 57B, 58A, and 58B having depths equivalent to ¼ of a guide wavelength of an electromagnetic wave of a leakage prevention object are provided in pairs around openings of the transmission lines 31, 32, 41, 51, and 52 facing each other across a gap between blocks. Accordingly, unintended leakage of electromagnetic waves to the transmission lines via the gap between the blocks is prevented, and isolation increases.

16 Claims, 19 Drawing Sheets

WAVEGUIDE SWITCH

TECHNICAL FIELD

The present invention relates to a waveguide switch for switching a propagation path of a waveguide having a transmission line surrounded by metal walls.

BACKGROUND ART

In the related art, a waveguide is used so as to effectively propagate electromagnetic waves having a region exceeding GHz, and in various devices using the waveguide, a waveguide switch for switching propagation paths of the electromagnetic waves is required.

As a structure which is used as the waveguide switch in the related art, a rotary type waveguide switch shown in FIG. 21 is known. A waveguide switch 10 includes a rotor portion 11 which is formed in a columnar shape and in which a center of a circle is rotatably supported by a shaft, and a stator portion 15 in which an inner circumferential wall faces an outer circumferential wall of the rotor portion 11 with a slight interval therebetween.

In the rotor portion 11, a first inner transmission line 12 which linearly penetrates from an outer circumferential wall to the opposite outer circumferential wall through a center along a direction orthogonal to a rotation center axis of the rotor portion 11, a second inner transmission line 13 which arcuately penetrates a portion between outer circumferential walls in which central angles are deviated by 45° from both ends of the first inner transmission line 12 in one side of the first inner transmission line 12, and a third inner transmission line 14 which arcuately penetrates a portion between outer circumferential walls in which central angles are deviated by 45° from both ends of the first inner transmission line 12 in the other side of the first inner transmission line 12 are provided. The three inner transmission lines 12 to 14 are formed at the same height.

In addition, in the stator portion 15, a first outer transmission line 16 and a second outer transmission line which penetrate from outer circumferential walls to inner circumferential walls along the direction orthogonal to the rotation center axis of the rotor portion 11 are provided, and a third outer transmission line 18 and a fourth outer transmission line 19 are provided so as to be orthogonal to the first and second outer transmission lines 16 and 17. The four outer transmission lines 16 to 19 are formed at the same height as the heights of the inner transmission lines 12 to 14.

In the waveguide switch 10 having the above-described structure, as shown in FIG. 21(*a*), if a rotation position of the rotor portion 11 is set in a state where the first inner transmission line 12, the first outer transmission line 16, and the second outer transmission line 17 are linearly arranged, it is possible to connect the first outer transmission line 16 and the second outer transmission line 17 to each other.

In addition, if the rotor portion 11 rotates left by 45° from the state of FIG. 21(*a*), as shown in FIG. 21(*b*), the first outer transmission line 16 and the fourth outer transmission line 19 are connected to each other via the second inner transmission line 13, and the second outer transmission line 17 and the third outer transmission line are connected to each other via the third inner transmission line 14.

Inversely, if the rotor portion 11 rotates right by 45° from the state of FIG. 21(*a*), as shown in FIG. 21(*c*), the second outer transmission line 17 and the fourth outer transmission line 19 are connected to each other via the second inner transmission line 13, and the first outer transmission line 16 and the third outer transmission line are connected to each other via the third inner transmission line 14.

Accordingly, for example, when electromagnetic waves are input to the first outer transmission line 16, the electromagnetic waves can be output from the second outer transmission line 17 in the state of FIG. 21(*a*), the electromagnetic waves can be output from the fourth outer transmission line 19 in the state of FIG. 21(*b*), and the electromagnetic waves can be output from the third outer transmission line 18 in the state of FIG. 21(*c*).

In addition, for example, the above-described rotary type waveguide switch is disclosed in Patent Document 1.

RELATED ART DOCUMENT

Patent Document

[Patent Document 1] Japanese Unexamined Patent Application Publication No. 05-55802

DISCLOSURE OF THE INVENTION

Problem that the Invention is to Solve

However, for example, when the above-described rotary type waveguide switch is a M to 1 switch in which the number of the outer transmission lines for inputting electromagnetic waves is a plural number M and the number of the outer transmission lines for outputting the electromagnetic waves is 1, M inner transmission lines provided in the rotor portion 11 are required. However, since the number of the transmission lines penetrating the rotor portion 11 is limited by the size of the rotor portion 11, an outer diameter of the rotor portion 11 needs to be increased in order to increase the number of the transmission lines, and a size of the entire switch increases. Moreover, the outer transmission lines are necessarily disposed radially, the input transmission lines and the output transmission lines are close to each other, isolation deteriorates, and a disposition of a circuit around the waveguide switch is significantly limited.

In addition, in a movable waveguide switch in which the transmission lines are mechanically moved as described above, it is necessary to provide a gap required for the movement. In the case of the rotary type waveguide switch, it is necessary to provide a gap between an outer circumference of the rotor portion 11 and an inner circumference of the stator portion 15. The electromagnetic waves are unintentionally leaked to the transmission lines via the gap, and there is a problem in that isolation due to the leakage deteriorates. As one method for solving the above-described problem, the periphery of an opening of the inner transmission line on the outer circumference of the rotor portion 11 protruding so as to come into contact with an inner wall of the stator portion 15, and leakage of the electromagnetic waves from the opening being prevented can be considered. However, in this contact type waveguide switch, abrasion occurs according to the rotation of the rotor portion 11, and durability significantly decreases.

The present invention is made so as to solve the above-described problems, and an object thereof is to provide a waveguide switch in which the number of instances of switching are able to be decreased, preventing deterioration of isolation due to leakage of the electromagnetic waves generated from the gap which is required for the input transmission line and the output transmission line to approach each other or for switching the transmission lines, and having high durability without being limited with respect to disposition of a peripheral circuit.

Means for Solving the Problem

In order to achieve the object, according to a first aspect of the present invention, there is provided a waveguide switch, including: a base portion; a first fixing waveguide block which is fixed to the base portion and in which a plurality of transmission lines surrounded by metal walls is formed to penetrate to a first end surface; a second fixing waveguide block which is fixed to the base portion and has a second end surface parallel to the first end surface of the first fixing waveguide block, and in which a transmission line surrounded by metal walls is formed to penetrate from the second end surface; and a movable waveguide block which includes a third end surface which is parallel to and faces the first end surface of the first fixing waveguide block at a predetermined interval from the first end surface, a fourth end surface which is parallel to and faces the second end surface of the second fixing waveguide block at a predetermined interval from the second end surface, and a plurality of transmission lines surrounded by metal walls which are formed to penetrate from the third end surface to the fourth end surface, and which is supported by the base portion in a state where the movable waveguide block can slide in parallel to the first end surface of the first fixing waveguide block and the second end surface of the second fixing waveguide block due to a drive device.

According to a second aspect of the present invention, in the waveguide switch described in the first aspect, the plurality of transmission lines of the first fixing waveguide block are formed to penetrate from a fifth end surface facing the first end surface toward the first end surface, the transmission line of the second fixing waveguide block is formed to penetrate from the second end surface toward a sixth end surface facing the second end surface, the drive device is provided in the base portion, and the movable waveguide block is formed such that some of the plurality of transmission lines of the movable waveguide block connect some of the plurality of transmission lines of the first fixing waveguide block and the transmission line of the second fixing waveguide block when the movable waveguide block is positioned at a first position, and some other portions of the transmission lines of the movable waveguide block connect some other portions of the plurality of transmission lines of the first fixing waveguide block and the transmission line of the second fixing waveguide block when the movable waveguide block is positioned at a second position.

According to a third aspect of the present invention, in the waveguide switch described in the first aspect, grooves having a depth equivalent to ¼ of a guide wavelength of a leakage prevention object frequency are provided to prevent leakage of electromagnetic waves from a gap between the blocks at a position of a portion which surrounds each of openings of the plurality of transmission lines of the first fixing waveguide block on the first end surface side of the first fixing waveguide block, a position of a portion which surrounds an opening of the waveguide of the second fixing waveguide block on the second end surface side of the second fixing waveguide block, and a position of a portion which surrounds each of openings of the plurality of waveguides of the movable waveguide block on the third end surface side and the fourth end surface side of the movable waveguide block.

According to a fourth aspect of the present invention, in the waveguide switch described in the second aspect, grooves having a depth equivalent to ¼ of a guide wavelength of a leakage prevention object frequency are provided to prevent leakage of electromagnetic waves from a gap between the blocks at a position of a portion which surrounds each of openings of the plurality of transmission lines of the first fixing waveguide block on the first end surface side of the first fixing waveguide block, a position of a portion which surrounds an opening of the waveguide of the second fixing waveguide block on the second end surface side of the second fixing waveguide block, and a position of a portion which surrounds each of openings of the plurality of waveguides of the movable waveguide block on the third end surface side and the fourth end surface side of the movable waveguide block.

According to a fifth aspect of the present invention, in the waveguide switch described in the third aspect, the plurality of grooves are concentrically provided at predetermined intervals.

According to a sixth aspect of the present invention, in the waveguide switch described in the fourth aspect, the plurality of grooves are concentrically provided at predetermined intervals.

According to a seventh aspect of the present invention, in the waveguide switch described in the fifth aspect, a distance between the openings of the transmission lines of each of the first end surface side of the first fixing waveguide block, the second end surface side of the second fixing waveguide block, and the third end surface side and the fourth end surface side of the movable waveguide block and an inner groove is ¼ of a guide wavelength of a frequency in a region sufficiently lower than a lower limit of a transmission frequency region of the transmission line.

According to an eighth aspect of the present invention, in the waveguide switch described in the sixth aspect, a distance between the openings of the transmission lines of each of the first end surface side of the first fixing waveguide block, the second end surface side of the second fixing waveguide block, and the third end surface side and the fourth end surface side of the movable waveguide block and an inner groove is ¼ of a guide wavelength of a frequency in a region sufficiently lower than a lower limit of a transmission frequency region of the transmission line.

According to a ninth aspect of the present invention, in the waveguide switch described in the fifth aspect, a distance between an inner groove and an outer groove of each of the first end surface side of the first fixing waveguide block, the second end surface side of the second fixing waveguide block, and the third end surface side and the fourth end surface side of the movable waveguide block is ¼ of a guide wavelength of an odd number multiple of a transmission center frequency of the transmission line.

According to a tenth aspect of the present invention, in the waveguide switch described in the sixth aspect, a distance between an inner groove and an outer groove of each of the first end surface side of the first fixing waveguide block, the second end surface side of the second fixing waveguide block, and the third end surface side and the fourth end surface side of the movable waveguide block is ¼ of a guide wavelength of an odd number multiple of a transmission center frequency of the transmission line.

According to an eleventh aspect of the present invention, in the waveguide switch described in the seventh aspect, a distance between an inner groove and an outer groove of each of the first end surface side of the first fixing waveguide block, the second end surface side of the second fixing waveguide block, and the third end surface side and the fourth end surface side of the movable waveguide block is ¼ of a guide wavelength of an odd number multiple of a transmission center frequency of the transmission line.

According to a twelfth aspect of the present invention, in the waveguide switch described in the eighth aspect, a distance between an inner groove and an outer groove of each of the first end surface side of the first fixing waveguide block, the second end surface side of the second fixing waveguide block, and the third end surface side and the fourth end surface side of the movable waveguide block is ¼ of a guide wavelength of an odd number multiple of a transmission center frequency of the transmission line.

According to a thirteenth aspect of the present invention, in the waveguide switch described in the first aspect, an upper surface, a side surface, and a lower surface of the waveguide switch are covered with a metal case, and an upper surface and a side surface of the movable waveguide block are not in contact with an inner wall of the metal case.

According to a fourteenth aspect of the present invention, in the waveguide switch described in the second aspect, an upper surface, a side surface, and a lower surface of the waveguide switch are covered with a metal case, and an upper surface and a side surface of the movable waveguide block are not in contact with an inner wall of the metal case.

According to fifteenth aspect of the present invention, in the waveguide switch described in the third aspect, an upper surface, a side surface, and a lower surface of the waveguide switch are covered with a metal case, and an upper surface and a side surface of the movable waveguide block are not in contact with an inner wall of the metal case.

According to a sixteenth aspect of the present invention, in the waveguide switch described in the fourth aspect, an upper surface, a side surface, and a lower surface of the waveguide switch are covered with a metal case, and an upper surface and a side surface of the movable waveguide block are not in contact with an inner wall of the metal case.

According to a seventeenth aspect of the present invention, in the waveguide switch described in the fifth aspect, an upper surface, a side surface, and a lower surface of the waveguide switch are covered with a metal case, and an upper surface and a side surface of the movable waveguide block are not in contact with an inner wall of the metal case.

According to an eighteenth aspect of the present invention, in the waveguide switch described in the sixth aspect, an upper surface, a side surface, and a lower surface of the waveguide switch are covered with a metal case, and an upper surface and a side surface of the movable waveguide block are not in contact with an inner wall of the metal case.

According to a nineteenth aspect of the present invention, in the waveguide switch described in the seventh aspect, an upper surface, a side surface, and a lower surface of the waveguide switch are covered with a metal case, and an upper surface and a side surface of the movable waveguide block are not in contact with an inner wall of the metal case.

According to a twentieth aspect of the present invention, in the waveguide switch described in the eighth aspect, an upper surface, a side surface, and a lower surface of the waveguide switch are covered with a metal case, and an upper surface and a side surface of the movable waveguide block are not in contact with an inner wall of the metal case.

Advantages of the Invention

In this way, in the waveguide switch of the present invention, since switching of propagation paths is performed by allowing the movable waveguide block to slide in parallel to the first end surface of the first fixing waveguide block and the second end surface of the second fixing waveguide block in the state where an interval from each of the first end surface and the second end surface is provided, even when the number of times of switching in the propagation paths increases, it is possible to cope with the increase of the number of times of switching by simply increasing the number of the transmission lines in the slide direction of the movable waveguide block, that is, by increasing a size only in one direction. Accordingly, it is possible to decrease the size of the waveguide switch, and unlike the rotary type waveguide switch, since the input port and the output port does not approach each other, there is less possibility of isolation deteriorating.

In addition, since grooves having a depth equivalent to ¼ of a guide wavelength of an electromagnetic wave of a leakage prevention object are provided around openings of the transmission lines facing each other across a gap between the blocks, unintended leakage of electromagnetic waves to the transmission lines via the gap between the blocks can be prevented, and it is possible to obtain high isolation. Moreover, since it is possible to prevent leakage of the electromagnetic waves even when the gap is provided between the blocks, unlike a contact type waveguide switch, a decrease in durability due to abrasion does not occur, and it is possible to obtain high durability.

In addition, since the plurality of grooves are concentrically provided, it is possible to further decrease leakage of the electromagnetic waves, and it is possible to obtain higher isolation.

BEST MODE FOR CARRYING OUT THE INVENTION

Hereinafter, an embodiment of the present invention will be described with reference to the drawings.

Figure 1:
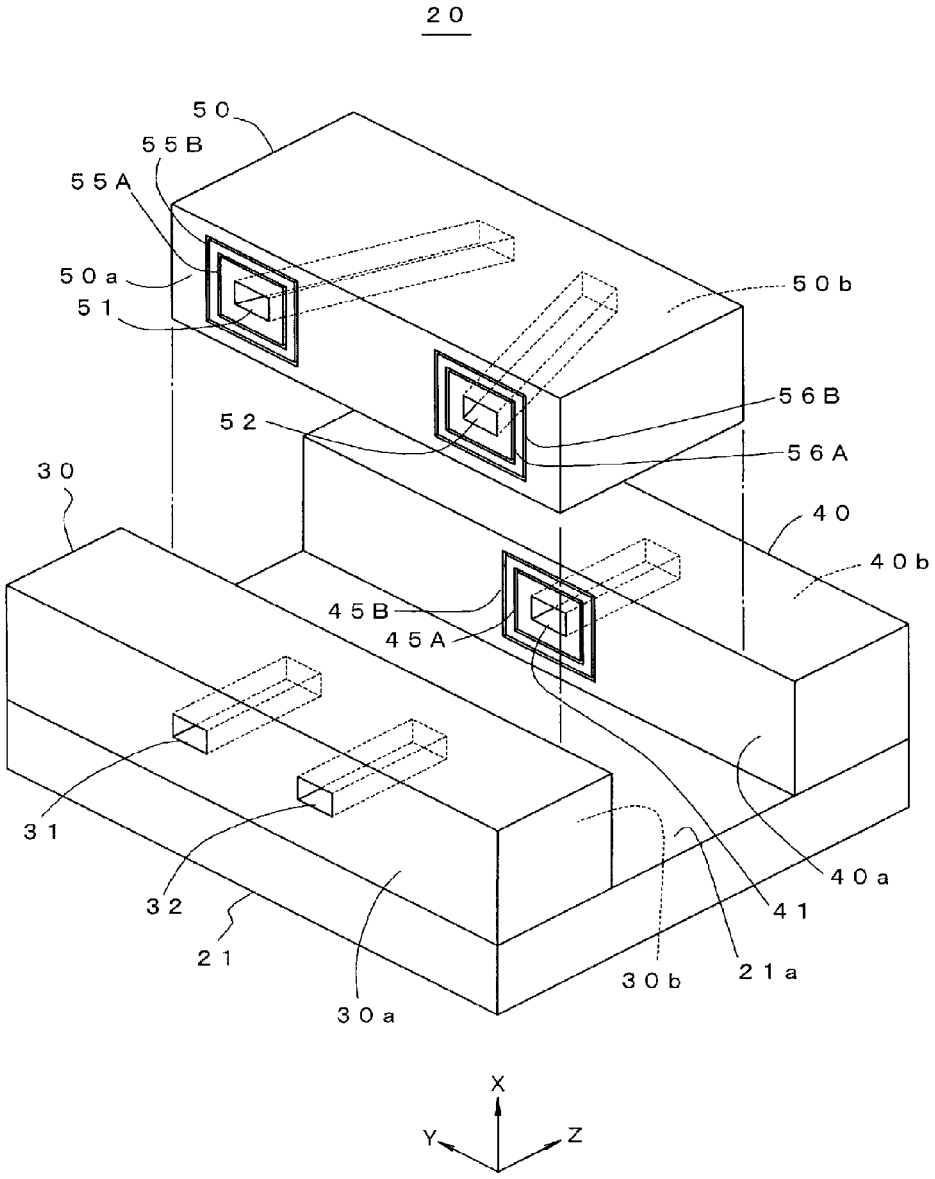
FIG. 1 is an exploded view showing a structure of an embodiment of the present invention.
Figure 2:
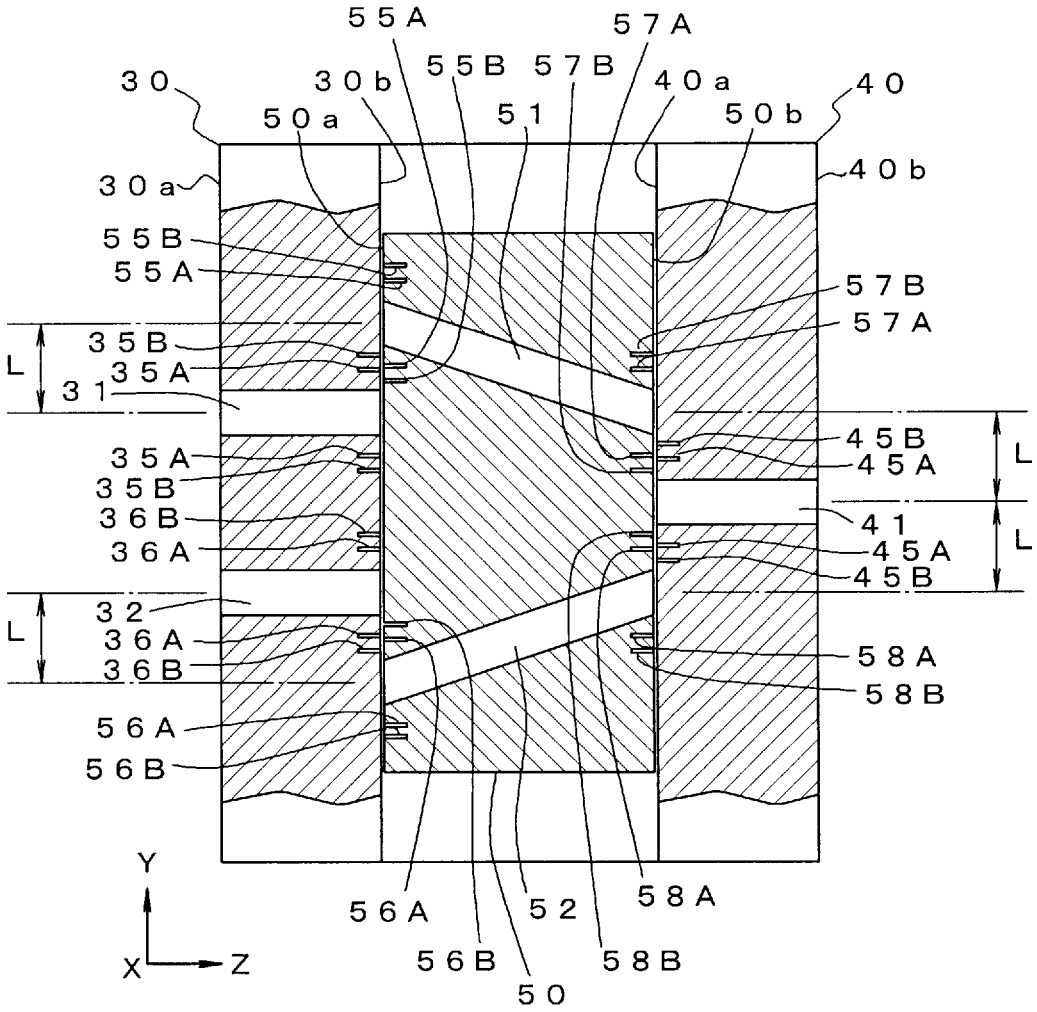
FIG. 2 is a plan view showing the structure of the embodiment of the present invention.
Figure 3:
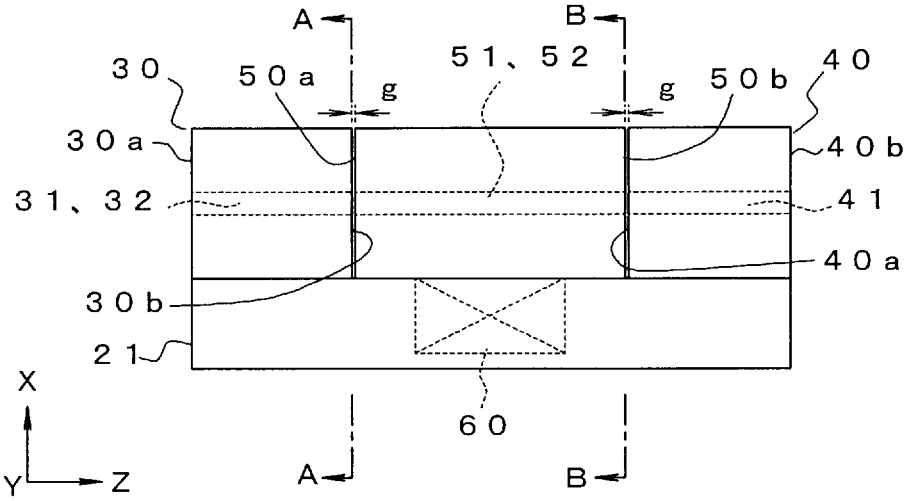
FIG. 3 is a side view showing the structure of the embodiment of the present invention.
Figure 4:
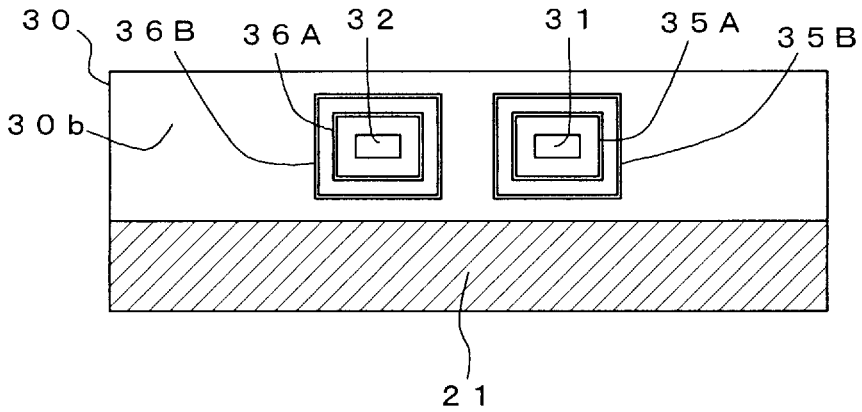
FIG. 4 is a sectional view taken along line A-A of FIG. 3.
Figure 5:
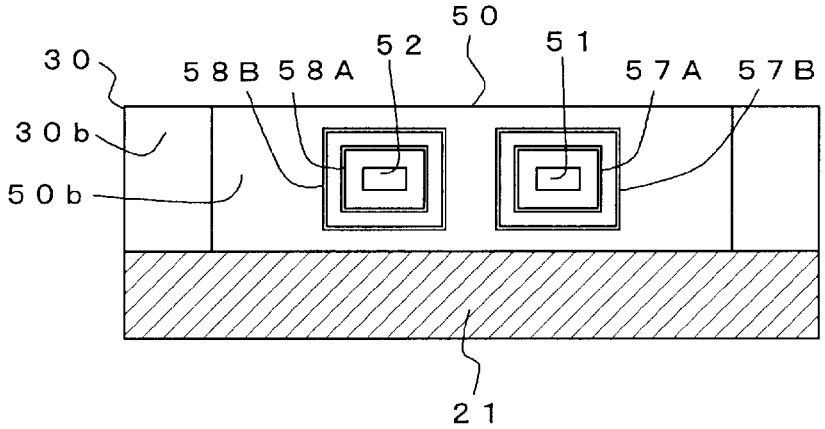
FIG. 5 is a sectional view taken along line B-B of FIG. 3.

FIGS. 1 to 5 show a configuration of a waveguide switch 20 to which the present invention is applied, FIG. 1 is an exploded view, FIG. 2 is a plan view, FIG. 3 is a side view, FIG. 4 is a sectional view taken along line A-A of FIG. 3, and FIG. 5 is a sectional view taken along line B-B of FIG. 3.

As shown in the drawings, the waveguide switch 20 includes a base portion 21, a first fixing waveguide block 30, a second fixing waveguide block 40, and a movable waveguide block 50.

An outline of the base portion 21 is formed in a rectangular shape, the first fixing waveguide block 30 is fixed to one end side of an upper surface 21*a* of the base portion 21, and the second fixing waveguide block 40 is fixed to the other end side of the upper surface 21*a*.

The first fixing waveguide block 30 is formed in a rectangular parallelepiped shape, and is formed so that a plurality of (two in this example) transmission lines 31 and 32 which are surrounded by metal walls and have predetermined sectional sizes penetrate from a fifth end surface 30*a* to a first end surface 30*b* opposite to the fifth end surface 30*a*. Here, for example, each of the two transmission lines 31 and 32 has a sectional size (for example, approximately 2 mm×1 mm) capable of propagating electromagnetic waves of a millimeter wave band in a single mode (TE10 mode), and the two transmission lines 31 and 32 are formed so as to be parallel to each other with a predetermined interval therebetween in a direction orthogonal to the fifth end surface 30*a* and the first end surface 30*b* at the same height as each other from the upper surface 21*a* of the base portion 21.

Meanwhile, an outline of the second fixing waveguide block 40 is formed in the same rectangular parallelepiped shape as the outline of the first fixing waveguide block 30, the second fixing waveguide block 40 is fixed to the base portion 21 in a state where a second end surface 40*a* of the second fixing waveguide block 40 is parallel to and faces the first end surface 30*b* of the first fixing waveguide block 30 at a predetermined distance therefrom, and a transmission line 41 surrounded by metal walls is formed to penetrate from the second end surface 40*a* to a sixth end surface 40*b* opposite to the second end surface 40*a*. The sectional size and the height of the transmission line 41 are the same as those of the transmission lines 31 and 32 of the first fixing waveguide block 30, and the transmission line 41 is formed on a line passing through an intermediate portion of the transmission lines 31 and 32.

In addition, this embodiment shows the structure example in which the first end surface 30*b* of the first fixing waveguide block 30 and the second end surface 40*a* of the second fixing waveguide block 40 are parallel to and face each other in the state of being separated from each other by a predetermined distance. However, as described below, a structure example may be realized in which the first end surface 30*b* of the first fixing waveguide block 30 and the second end surface 40*a* of the second fixing waveguide block 40 face in the same direction so as to be flush with each other.

The movable waveguide block 50 is slidably supported between the first end surface 30*b* of the first fixing waveguide block 30 and the second end surface 40*a* of the second fixing waveguide block 40 on the upper surface 21*a* of the base portion 21. The movable waveguide block 50 is formed in a rectangular parallelepiped shape which has a slightly (for example, 60 μm) shorter length than the distance between the first end surface 30*b* of the first fixing waveguide block 30 and the second end surface 40*a* of the second fixing waveguide block 40 and approximately the same height as the height of each of both fixing waveguide blocks 30 and 40, and two transmission lines 51 and 52 corresponding to the number of transmission lines 31 and 32 formed in the first fixing waveguide block 30 are formed so as to penetrate from a third end surface 50*a* which is parallel to and faces the first end surface 30*b* of the first fixing waveguide block 30 with a gap g (for example, g=30 μm) between it and the first end surface 30*b* to a fourth end surface 50*b* which is parallel to and faces the second end surface 40*a* of the second fixing waveguide block 40 with the gap g between it and the second end surface 40*a*.

The sectional size and the height of each of the transmission lines 51 and 52 of the movable waveguide block 50 are the same as those of each of the transmission lines 31 and 32 of the first fixing waveguide block 30 and those of the transmission line 41 of the second fixing waveguide block 40, and in a position (hereinafter, referred to as a neutral state) shown in FIG. 2, the opening position of each of the transmission lines 51 and 52 of a third end surface 50*a* side is positioned so as to be separated by L outward from the opening position of each of the transmission lines 31 and 32 of the first fixing waveguide block 30, and the opening positions of the transmission lines 51 and 52 of the fourth end surface 50*b* side are positioned so as to be separated by L toward both sides from the opening position of the second fixing waveguide block 40.

Figure 6:
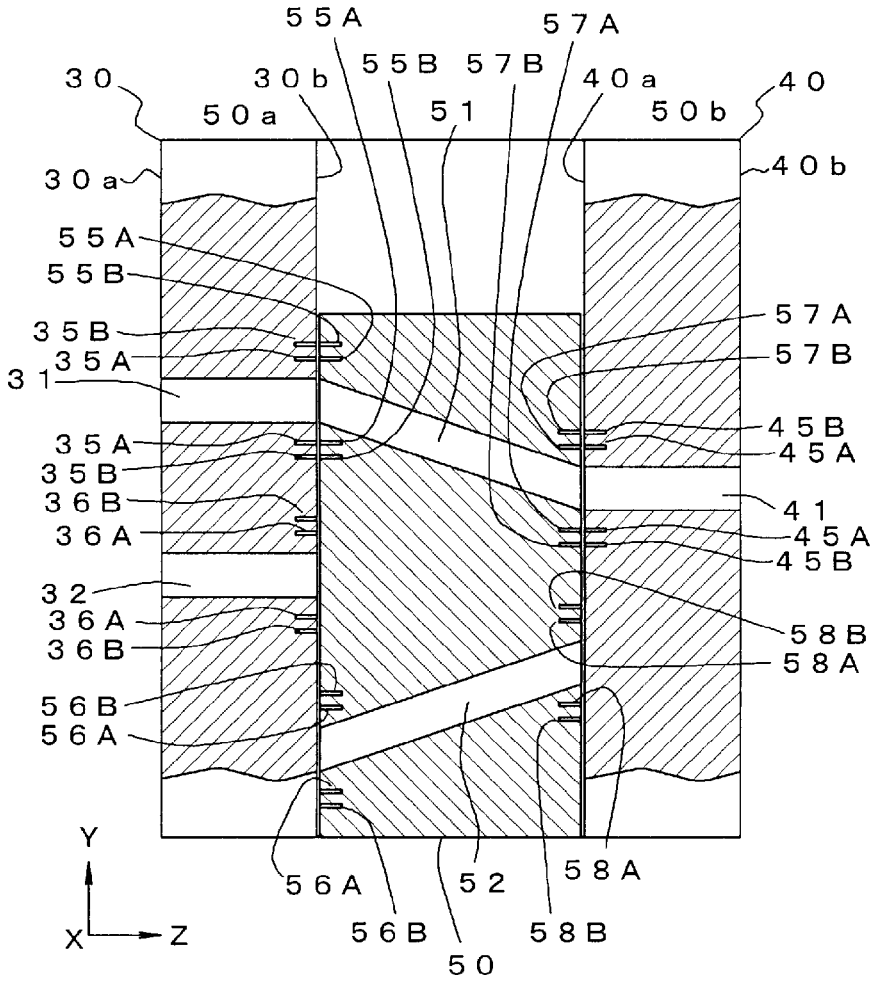
FIG. 6 is a view explaining a switching operation of the embodiment.

Accordingly, as shown in FIG. 6, in a first position at which the movable waveguide block 50 slides by −L in a width direction (Y direction) from the neutral state, the opening position of one transmission line 31 of the first end surface 30*b* side of the first fixing waveguide block 30 coincides with the opening position of one transmission line 51 of the third end surface 50*a* side of the movable waveguide block 50, the opening position of the transmission line 41 of the second end surface 40*a* side of the second fixing waveguide block 40 coincides with the opening position of one transmission line 51 of the fourth end surface 50*b* side of the movable waveguide block 50, and one transmission line 31 of the first fixing waveguide block 30 and the transmission line 41 of the second fixing waveguide block 40 are connected to each other via the transmission line 51.

Figure 7:
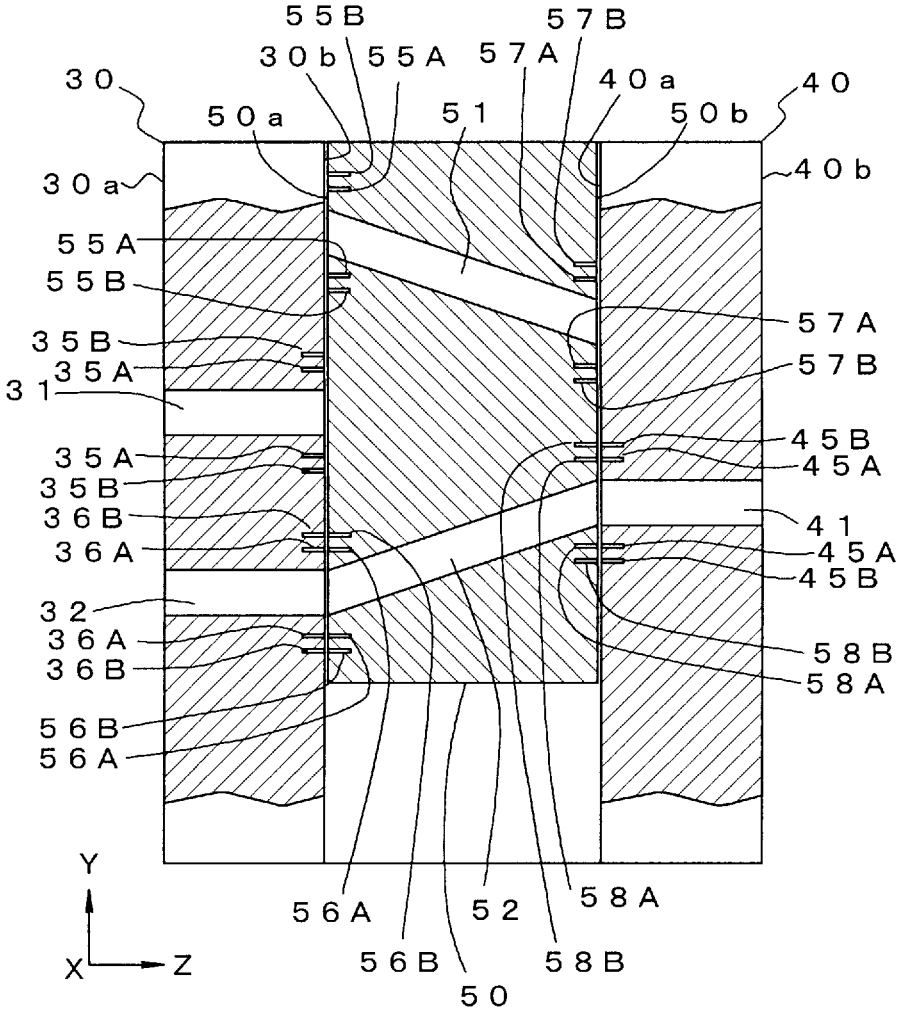
FIG. 7 is a view explaining the switching operation of the embodiment.

In addition, in a second position at which the movable waveguide block 50 slides by 2 L in the width direction (Y direction) from the state of FIG. 6 (or the movable waveguide block 50 slides by L in the width direction from the neutral state of FIG. 2), as shown in FIG. 7, the opening position of the other transmission line 32 of the first end surface 30*b* side of the first fixing waveguide block 30 coincides with the opening position of the other transmission line 52 of the third end surface 50*a* side of the movable waveguide block 50, the opening position of the transmission line 41 of the second end surface 40*a* side of the second fixing waveguide block 40 coincides with the opening position of the other transmission line 52 of the fourth end surface 50*b* side of the movable waveguide block 50, and the other transmission line 32 of the first fixing waveguide block 30 and the transmission line 41 of the second fixing waveguide block 40 are connected to each other via the transmission line 52.

In addition, this example is configured so that the transmission line 41 of the second fixing waveguide block 40 is positioned on an extension line passing through the intermediate portion of the two transmission lines 31 and of the first fixing waveguide block 30 and the two transmission lines 51 and 52 of the movable waveguide block 50 are linearly symmetrical with respect to the extension line. However, an unsymmetrical structure may be adopted in which the transmission line 41 of the second fixing waveguide block 40 is not positioned on an extension line of a line passing through the intermediate portion of the two transmission lines 31 and 32 of the first fixing waveguide block 30, and in this case, the two transmission lines 51 and 52 of the movable waveguide block 50 are unsymmetrically disposed.

The movable waveguide block 50 is slidably supported by a drive device 60 which is provided in the base portion 21. The structure of the drive device 60 is arbitrarily adopted. For example, the structure may be realized by inverting a rotational movement of a stepping motor into a linear movement and transmitting the linear movement to a support member which supports the movable waveguide block 50 from a lower surface side of the base portion 21. In this case, a position and a movement distance of the movable waveguide block 50 are detected by a sensor, an encoder, or the like, and the movable waveguide block 50 may be controlled so as to be selectively movable between at least the first position of FIG. 6 and the second position of FIG. 7.

In the waveguide switch 20 of the embodiment, since the movable waveguide block 50 slides with respect to the first fixing waveguide block 30 and the second fixing waveguide block 40 and switching of propagation paths is performed, even when the number of times of switching in the propagation paths increases, it is possible to cope with the increase of the number of times of switching by simply increasing the number of the transmission lines in the slide direction (Y direction) of the movable waveguide block 50, that is, by increasing a size only in one direction. Accordingly, it is possible to decrease the size of the waveguide switch, and since the input port and the output port does not approach each other, there is less possibility of isolation deteriorating.

However, since the gap g between each of both fixing waveguide blocks 30 and 40 and the movable waveguide block needs to exist, leakage of electromagnetic waves through the gap g occurs. Particularly, when the electromagnetic waves have short wavelengths such as a millimeter wave band, considerable leakage occurs even in the slight gap of approximately 30 μm as described above, and for example, in the state of FIG. 6, electromagnetic waves input from the transmission line 31 are leaked to the disconnected transmission line 32 side via the gap g. Accordingly, isolation deteriorates.

In order to solve this problem, in the waveguide switch 20 of the embodiment, as shown in FIG. 4, two grooves 35A and 35B which are continuous in a rectangular frame shape with a predetermined width so as to surround the opening of one transmission line 31 of the first end surface 30*b* side of the first fixing waveguide block 30 and are formed so as to have depths equivalent to ¼ of guide wavelengths of the electromagnetic waves of a leakage prevention object are concentrically provided. In addition, in the other transmission line 32, similarly, two grooves 36A and 36B which are continuous in a rectangular frame shape with a predetermined width so as to surround the opening of the transmission line 32 and are formed so as to have depths equivalent to ¼ of guide wavelengths of the electromagnetic waves of a leakage prevention object are concentrically provided.

Each of the grooves 35A, 35B, 36A and 36B has a function which combines electromagnetic waves which are leaked from each opening of the transmission lines 31 and 32 to the gap between the blocks and reach the inlet of the groove, and electromagnetic waves which reciprocate in the groove, return to the inlet, and have inverted phases so as to cancel each other out. Accordingly, according to this function, it is possible to prevent the electromagnetic waves from being leaked outside the groove. In addition, here, two grooves are concentrically provided in each transmission line so as to increase leakage prevention effects. However, one groove may be provided. Moreover, conversely, when three grooves or four grooves are concentrically provided, it is possible to further increase leakage prevention effects. In addition, when the plurality of grooves are concentrically provided in each transmission line, if a depth of each groove is slightly changed, it is possible to prevent leakage of the electromagnetic waves over a wide frequency band.

Moreover, as shown in FIG. 1, two concentric grooves 45A and 45B which are continuous in a rectangular frame shape so as to surround the opening of the transmission line 41 are concentrically provided on the second end surface 40*a* side of the second fixing waveguide block 40 in depths equivalent to ¼ of guide wavelengths of the electromagnetic waves of a leakage prevention object.

In addition, as shown in FIGS. 1 and 5, two concentric grooves 55A and 55B, 56A and 56B for preventing leakage are provided around the openings of the transmission lines 51 and 52 of the third end surface 50*a* side of the movable waveguide block 50, and two concentric grooves 57A and 57B, 58A and 58B for preventing leakage are provided around the openings of the transmission lines 51 and 52 of the fourth end surface 50*b* side opposite to the third end surface 50*a*.

Moreover, here, all distances from the openings of the transmission lines to the inner grooves 35A, 36A, 45A, 55A, 56A, 57A, and 58A are the same as one another, and distances from the inner grooves 35A, 36A, 45A, 55A, 56A, 57A, and 58A to the outer grooves 35B, 36B, 45B, 55B, 56B, 57B, and 58B are the same as each other.

In a numerical example, when a transmission center frequency of a transmission line is 115 GHz, the depth of each groove is $(300\times10^6/115\times10^9)/4=0.65$ mm.

In addition, the distance from the opening of each transmission line to the inner groove is set to ¼ (for example, 1 mm) of the guide wavelength of a frequency (for example, 75 GHz) in a region sufficiently lower than a lower limit of a transmission frequency region (for example, 90 GHz to 140 GHz) of the transmission line, and reflection generated due to the section from the opening of the transmission line to the inner groove functioning as a band rejection filter is not generated within the transmission frequency region.

Moreover, the distance from the inner groove to the outer groove is set to an odd number multiple of ¼ (for example, 0.65 mm) of a guide wavelength of a transmission center frequency (for example, 115 GHz), the portion between the inner groove and the outer groove functions as the band rejection filter, and leakage prevention effects of electromagnetic waves increase.

In this way, in the waveguide switch 20 of the embodiment, since grooves for preventing leakage of electromagnetic waves are provided on the end surfaces facing each other with the gap between the blocks at positions surrounding the openings of the transmission lines, even when the gap is provided between the blocks, it is possible to prevent leakage of the electromagnetic waves and deterioration of isolation. In addition, unlike a contact type waveguide switch, a decrease in durability due to abrasion does not occur, and it is possible to obtain high durability.

Moreover, the upper surface, the side surfaces, and the lower surface of the waveguide switch 20 are covered with a metal case (not shown), and the upper surface and the side surfaces of the movable waveguide block 50 are in a non-contact state with the inner walls of the metal case.

Next, simulation results with respect to transmission characteristics of the waveguide switch 20 having the above-described configuration will be described. Conditions of simulation are as follows. The sectional section of each of the transmission lines 31, 32, 41, 51, and 52 is 2.032 mm×1.016 mm, the interval (a distance between side surfaces closer to each other) between the transmission lines 31 and 32 is 5 mm, the gap g between the blocks is 30 μm, the length (a length in the Z direction) of the movable waveguide block 50 is 10.0 mm, the width of each groove for preventing leakage of electromagnetic waves is 0.2 mm, the depth of each groove is 0.7 mm, the distance from the inner wall of each transmission line to the inner groove is 0.95 mm, and the distance between the inner groove and the outer groove is 0.65 mm.

Figure 8:
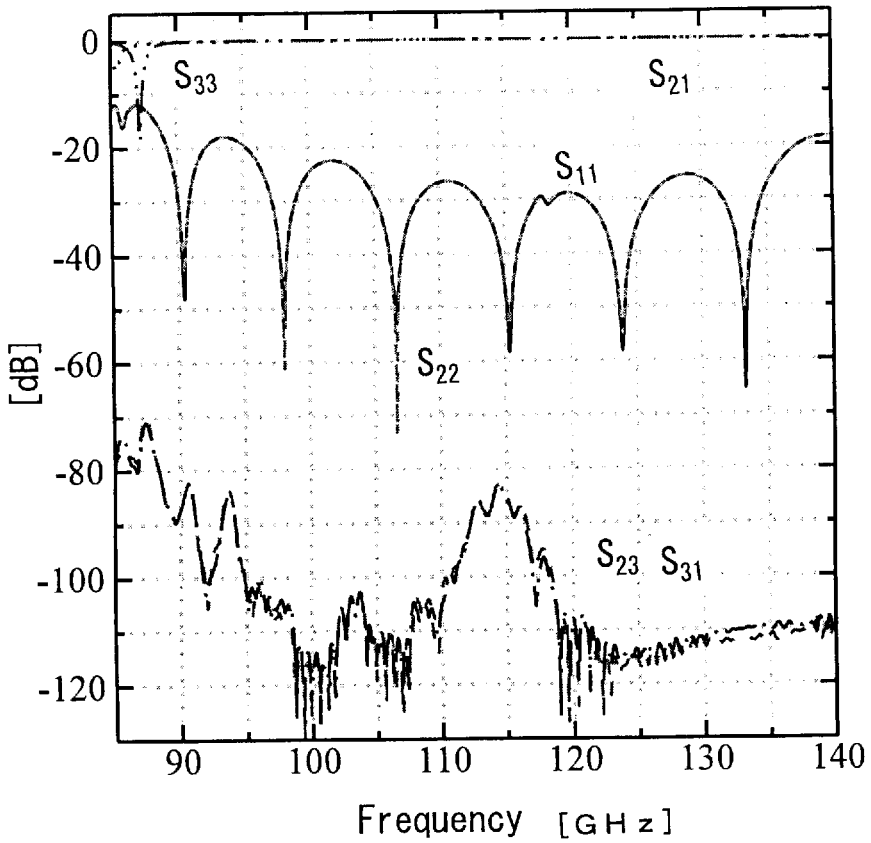
FIG. 8 is a view showing characteristics of the embodiment.

FIG. 8 shows results in which transmission characteristics (S parameter) are obtained based on the conditions in the state where the movable waveguide block is positioned at the first position and the transmission line 31 and the transmission line 41 are connected to each other via the transmission line 51.

As it is clear from FIG. 8, in a wide frequency range of 90 GHz to 140 GHz, a loss ($S_{21}$) between the transmission line 31 and the transmission line 41 is less than 0.5 dB, and isolation ($S_{23}$, $S_{31}$) between the transmission lines 31 and 41 and the transmission line 32 is equal to or more than 80 dB. In addition, a reflection coefficient ($S_{22}$) when viewed from the transmission line 31 side and a reflection coefficient ($S_{11}$) when viewed from the transmission line 41 side are less than or equal to −17 dB, and it is determined that the waveguide switch has excellent characteristics as a switch of a millimeter wave band (in FIG. 8, $S_{33}$ is a reflection coefficient when viewed from the transmission line 32 side, and in this case, the reflection is a total reflection, and $S_{33}$ has characteristics substantially overlapping with those of $S_{21}$).

Next, results of changes of characteristics with respect to position deviation of the movable waveguide block 50 will be described.

Figure 9:
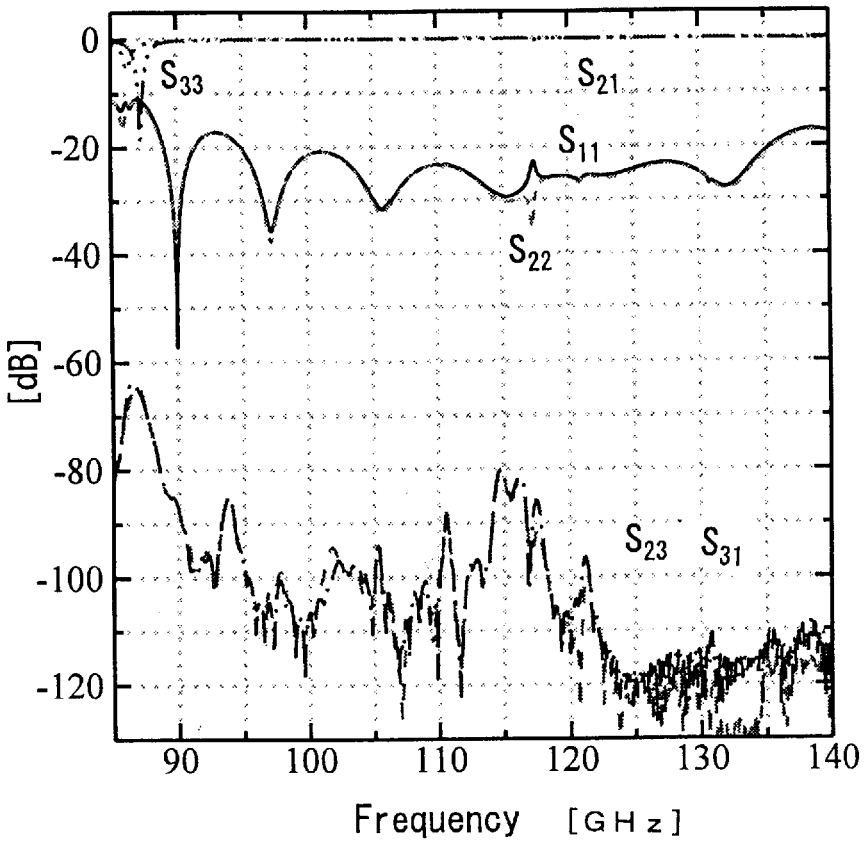
FIG. 9 is a view showing characteristics when a movable waveguide block is deviated by +0.1 mm in a width direction.
Figure 10:
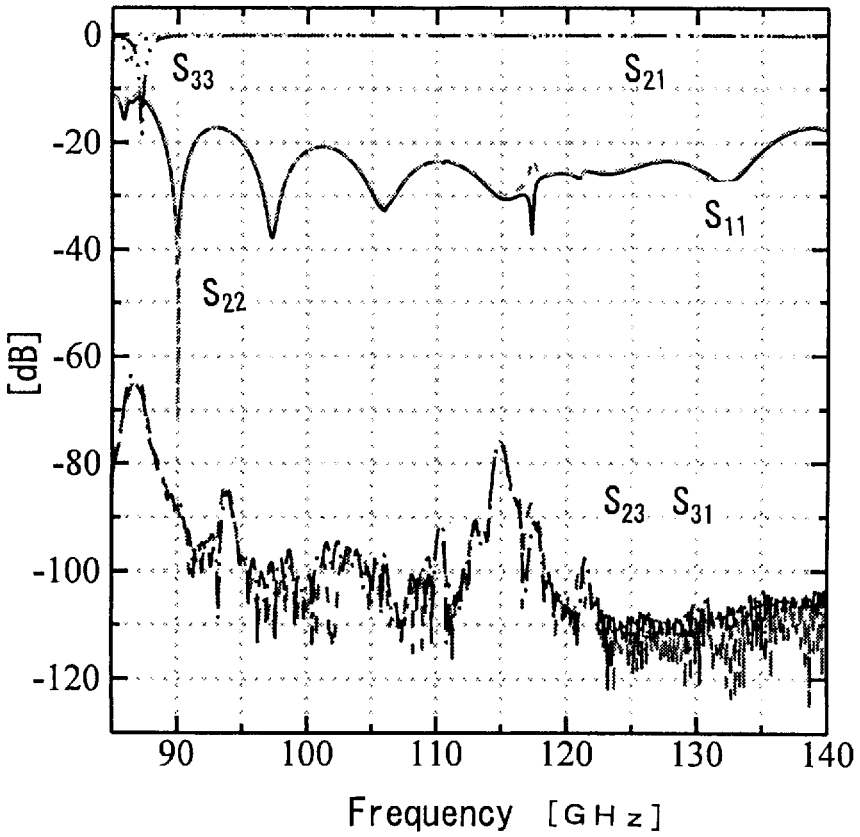
FIG. 10 is a view showing characteristics when the movable waveguide block is deviated by −0.1 mm in the width direction.
Figure 11:
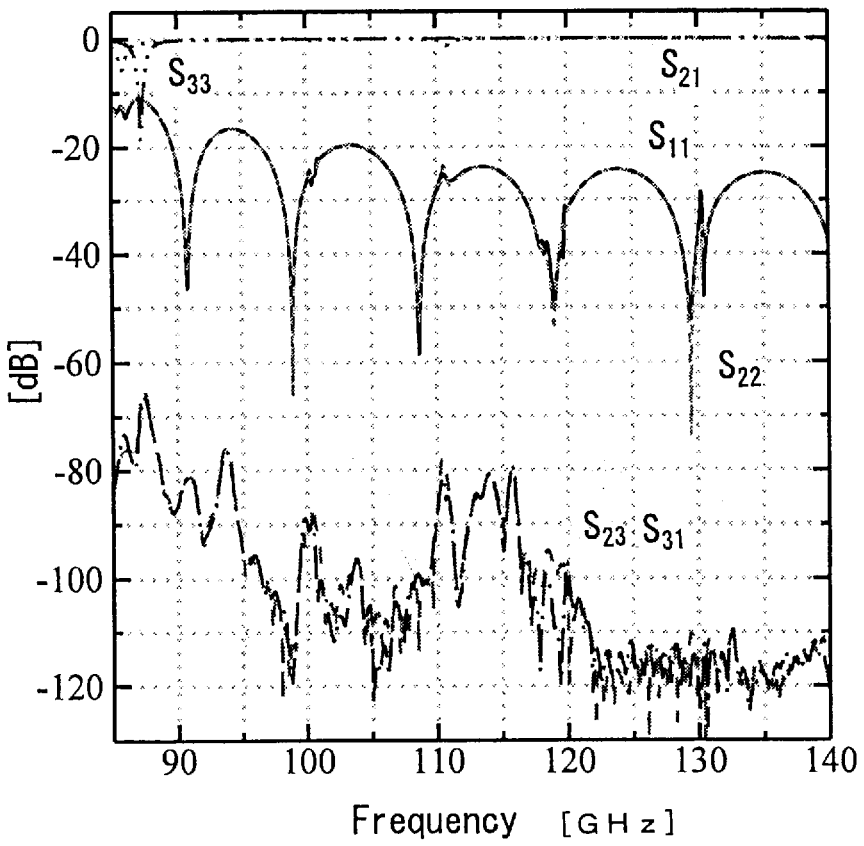
FIG. 11 is a view showing characteristics when the movable waveguide block is deviated by +0.1 mm in a height direction.
Figure 12:
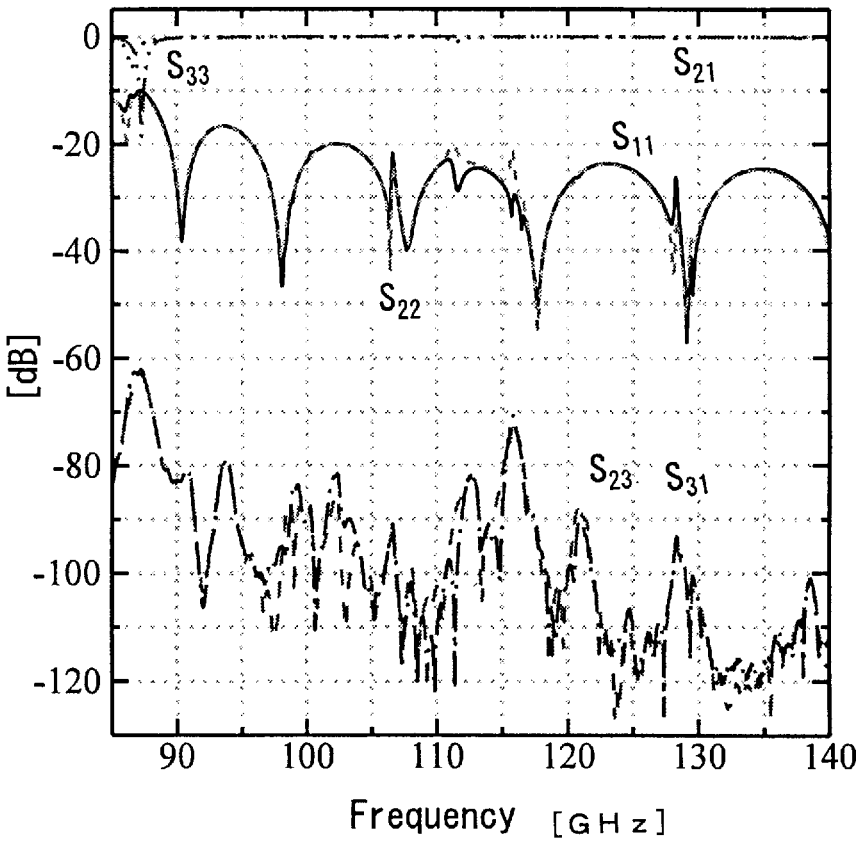
FIG. 12 is a view showing characteristics when the movable waveguide block is deviated by +0.1 mm in the height direction and the width direction.
Figure 13:
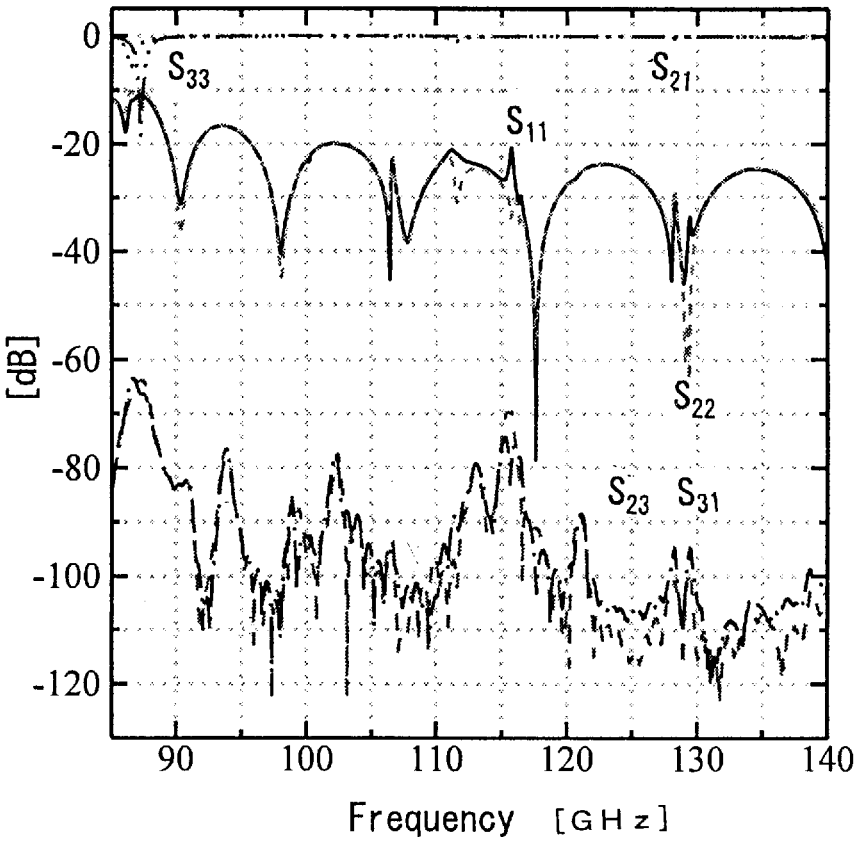
FIG. 13 is a view showing characteristics when the movable waveguide block is deviated by +0.1 mm in the height direction and is deviated by −0.1 mm in the width direction.

FIG. 9 shows characteristics when the transmission line 51 is deviated by +0.1 mm in the width direction (Y direction) with respect to a normal position, and FIG. 10 shows characteristics when the transmission line 51 is deviated by −0.1 mm in the width direction (Y direction). In addition, FIG. 11 shows characteristics when the transmission line 51 is deviated by 0.1 mm in the height direction (X direction), FIG. 12 shows characteristics when the transmission line 51 is deviated by 0.1 mm in the height direction (X direction) and is deviated by 0.1 mm in the width direction (Y direction), and FIG. 13 shows characteristics when the transmission line 51 is deviated by 0.1 mm in the height direction (X direction) and is deviated by −0.1 mm in the width direction (Y direction).

As it is clear from the results, even when the position of the movable waveguide block 50 (the position of the transmission line 51) is deviated by approximately 0.1 mm in the width direction or the height direction with respect to the normal position, the isolation slightly deteriorates (approximately 70 dB), and there is little loss or deterioration in the characteristics of the reflection. In an actual drive control, it is considered that accuracy of several μm is obtained even when the control is performed by a simple motor drive which does not have an encoder. Accordingly, it is possible to accurately perform switching of propagation paths of a millimeter wave band by a simple and inexpensive mechanism.

The above-described embodiment is a configuration example of a one-circuit and two-contact point type waveguide switch. However, in order to obtain a large number of times of switching, the number of transmission lines of the first fixing waveguide block 30 may be set to 3 or more, and according to this, the number of transmission lines of the movable waveguide block 50 may increase.

Figure 14:
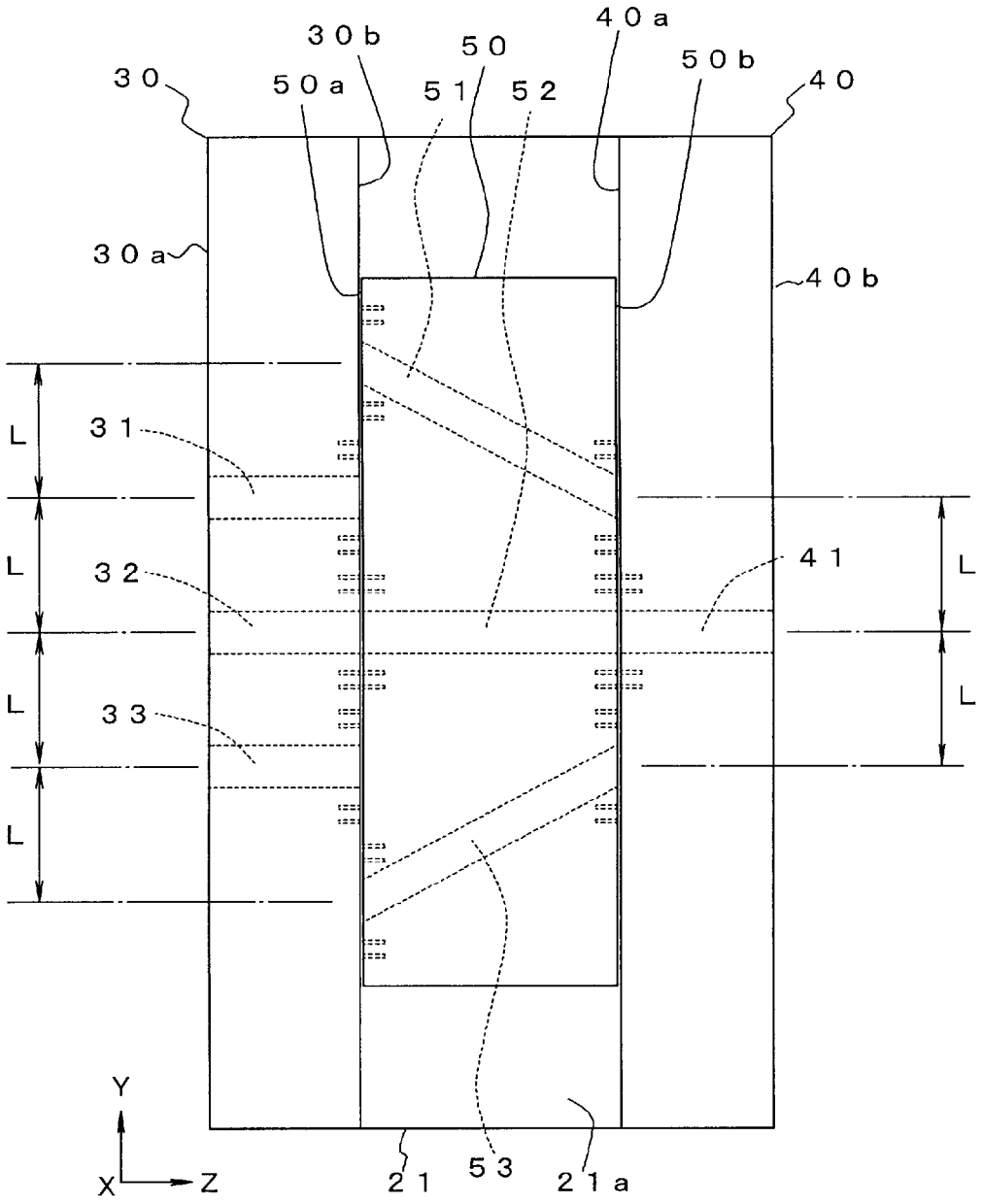
FIG. 14 is a view showing a structure example of a one-circuit and three-contact point type.

FIG. 14 shows an example of a one-circuit and three-contact point in which the number of contact points is 3, three transmission lines 31, 32, and 33 are provided in the first fixing waveguide block 30 at the interval L, and according to this, three transmission lines 51, 52, and 53 are provided in the movable waveguide block 50.

In this case, as shown in FIG. 14, a state where a center transmission line 52 among three transmission lines 51, 52, and 53 is arranged in a straight line with the transmission line 32 and the transmission line 41 of the second fixing waveguide block 40 is set to a reference position, and in this reference position, the position of each opening of the transmission lines 51 and 53 of the third end surface 50*a* side of the movable waveguide block 50 is separated outward from the position of each opening of the transmission lines 31 and 33 by L.

Figure 15:
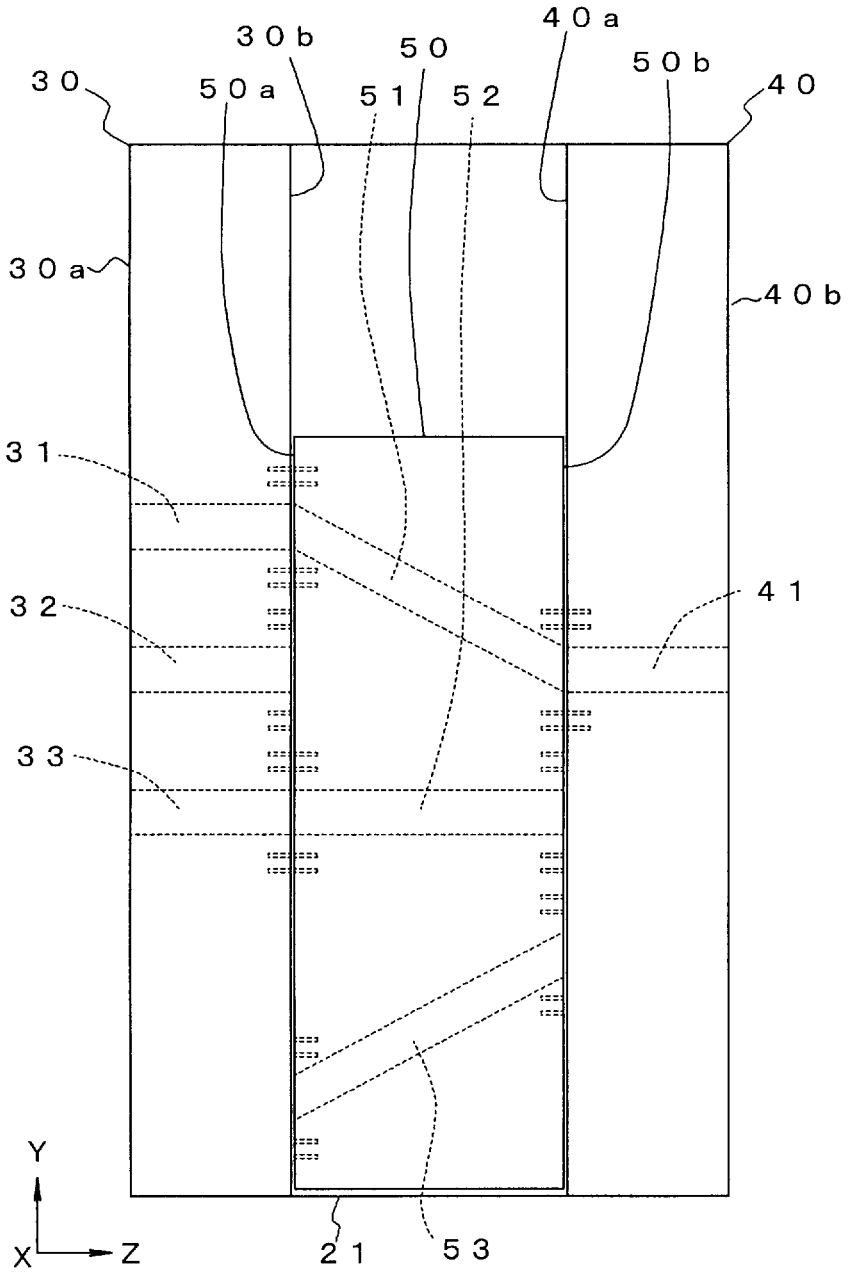
FIG. 15 is a view showing a switching operation of the structure example of FIG. 14.
Figure 16:
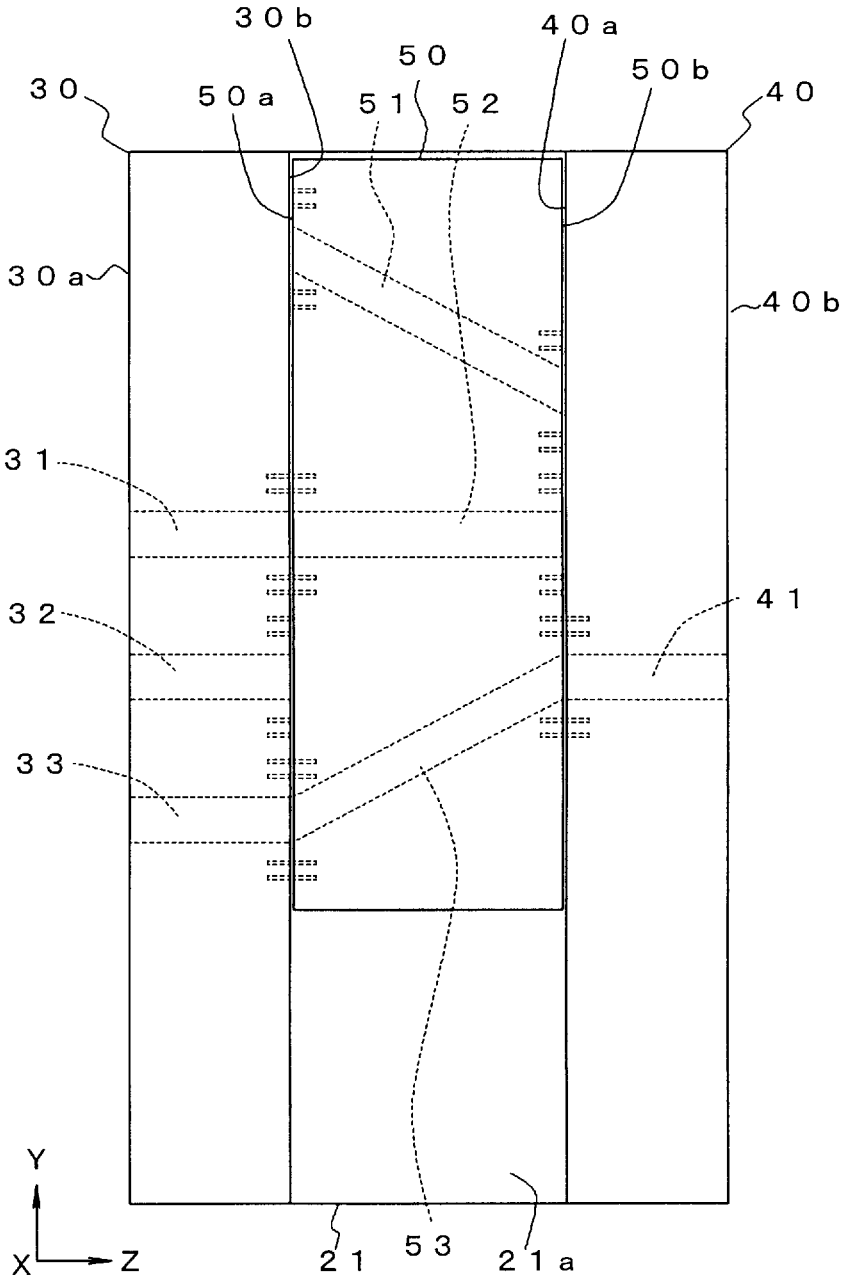
FIG. 16 is a view showing the switching operation of the structure example of FIG. 14.

In this reference position, the transmission line 32 and the transmission line 41 are connected to each other via the transmission line 52. Moreover, as shown in FIG. 15, if the movable waveguide block 50 slides in the width direction (Y direction) by −L from this position, the transmission line 31 and the transmission line 41 are connected to each other via the transmission line 51. Inversely, as shown in FIG. 16, if the movable waveguide block 50 slides in the width direction (Y direction) by +L, the transmission line 33 and the transmission line 41 are connected to each other via the transmission line 53. In this example structure, even when the number of contact points is three or more, the switching positions include the first position and the second position in the present invention.

Figure 17:
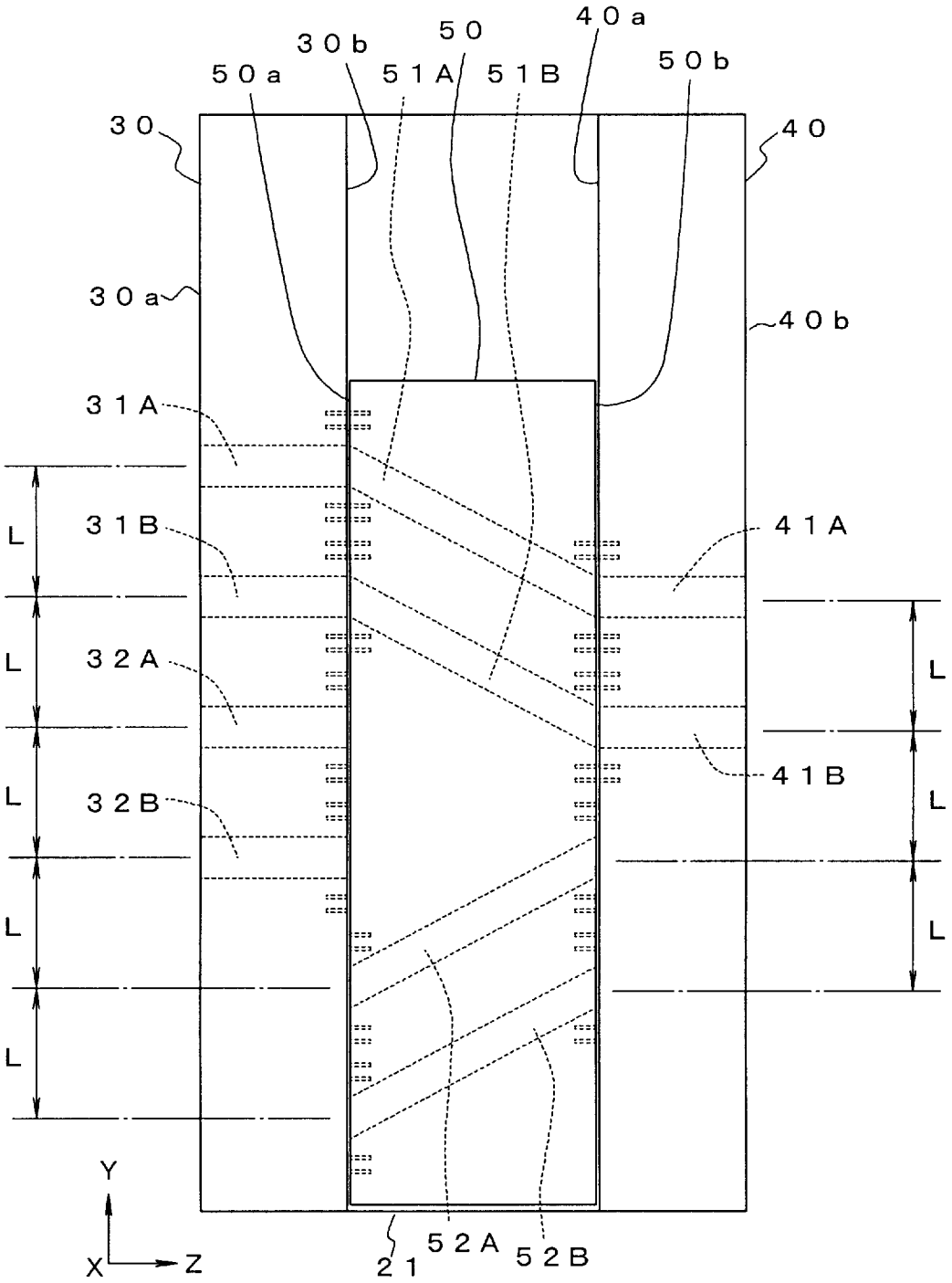
FIG. 17 is a view showing a structure of a two-circuit and two-contact point type.

In the example, the number of contact points increases. However, as shown in FIG. 17, the number of circuits may increase. This waveguide switch is a two-circuit and two-contact point type. Here, the transmission lines 31, 32, 41, 51, and 52 of the embodiment shown in FIGS. 1 to 6 are replaced by a pair of transmission lines 31A and 31B, a pair of transmission lines 32A and 32B, a pair of transmission lines 41A and 41B, a pair of transmission lines 51A and 51B, and a pair of transmission lines 52A and 52B in which the transmission lines of the pair are separated from each other at the interval L. In addition, in the state shown in FIG. 17 (first position), the transmission lines 31A and 31B and the transmission lines 41A and 41B are connected to each other via the transmission lines 51A and 51B. Moreover, if this state is brought into a state shown in FIG. 18 (second position) where the movable waveguide block 50 slides in the width direction (Y direction) by 2 L, the transmission lines 32A and 32B and the transmission lines 41A and 41B are connected to each other via the transmission lines 52A and 52B.

Moreover, although it is not shown in the drawings, if there are set to be three pairs of the transmission lines of each of the first fixing waveguide block 30 and the movable waveguide block 50 of the waveguide switch shown in FIG. 17, a two-circuit and three-contact point type waveguide switch can be configured.

Figure 19:
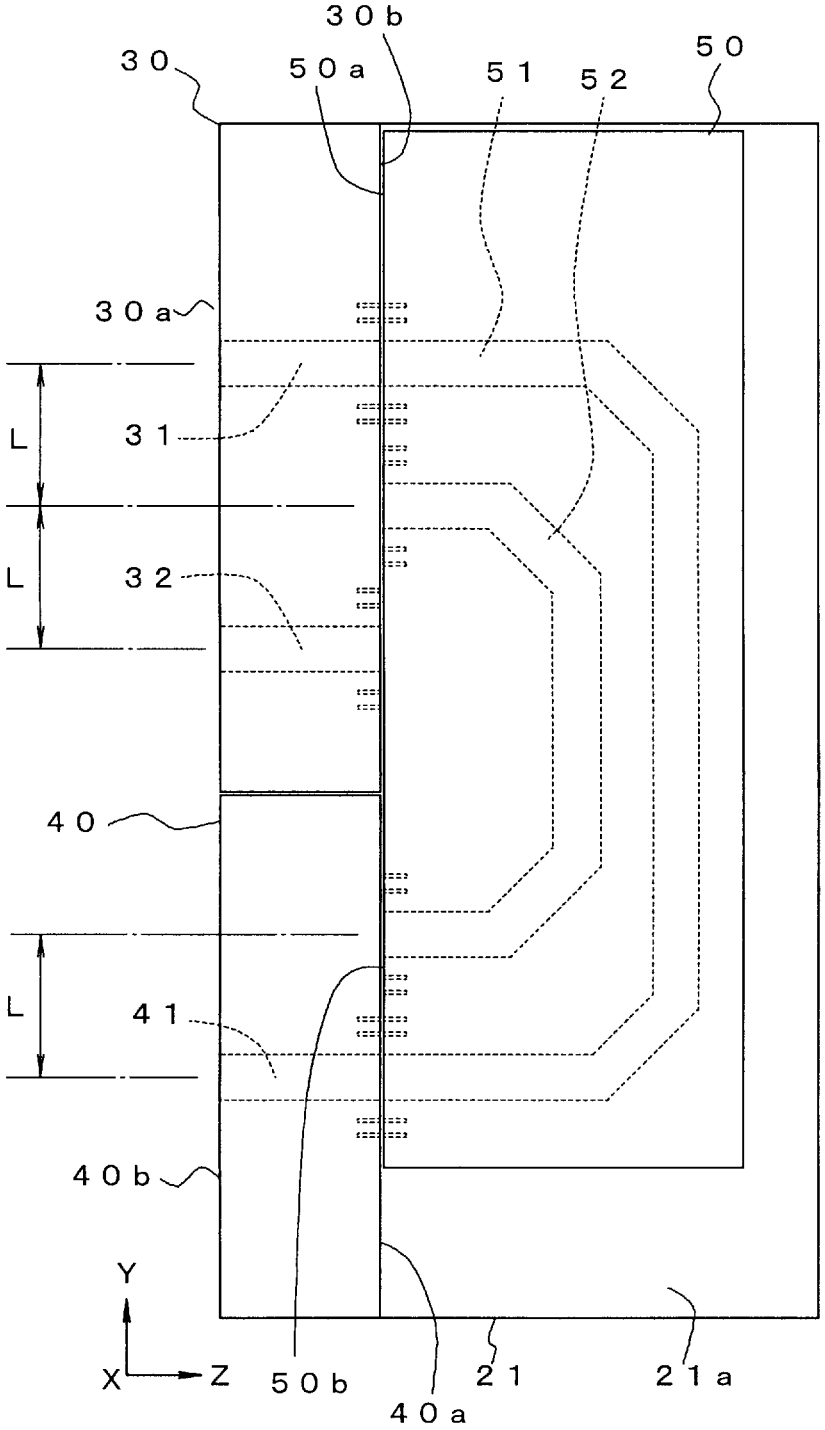
FIG. 19 is a view showing a structure example in which disposition of waveguide blocks is modified.

In addition, in this embodiment, the first end surface 30*b* of the first fixing waveguide block 30 and the second end surface 40*a* of the second fixing waveguide block 40 face each other so as to be parallel to each other with a predetermined distance therebetween, and the movable waveguide block 50 is disposed therebetween. However, as shown in FIG. 19, the first end surface 30*b* of the first fixing waveguide block 30 and the second end surface 40*a* of the second fixing waveguide block 40 may be disposed so as to be parallel to each other, to be flush with each other, and to face in the same direction, and the third end surface 50*a* and the fourth end surface 50*b* of the movable waveguide block 50 may be disposed so as to be parallel to each other, to be flush with each other, and to face in the same direction. In this structure, the first fixing waveguide block 30 and the second fixing waveguide block 40 are integrated with each other, the first end surface 30*b* and the second end surface 40*a* are continuous with each other, and the third end surface 50*a* and the fourth end surface 50*b* of the movable waveguide block 50 is continuous with each other. However, in the case of this structure example, the interval between the transmission lines 31 and 32 is twice the interval L between the positions of the openings of the transmission lines 51 and 52.

Figure 20:
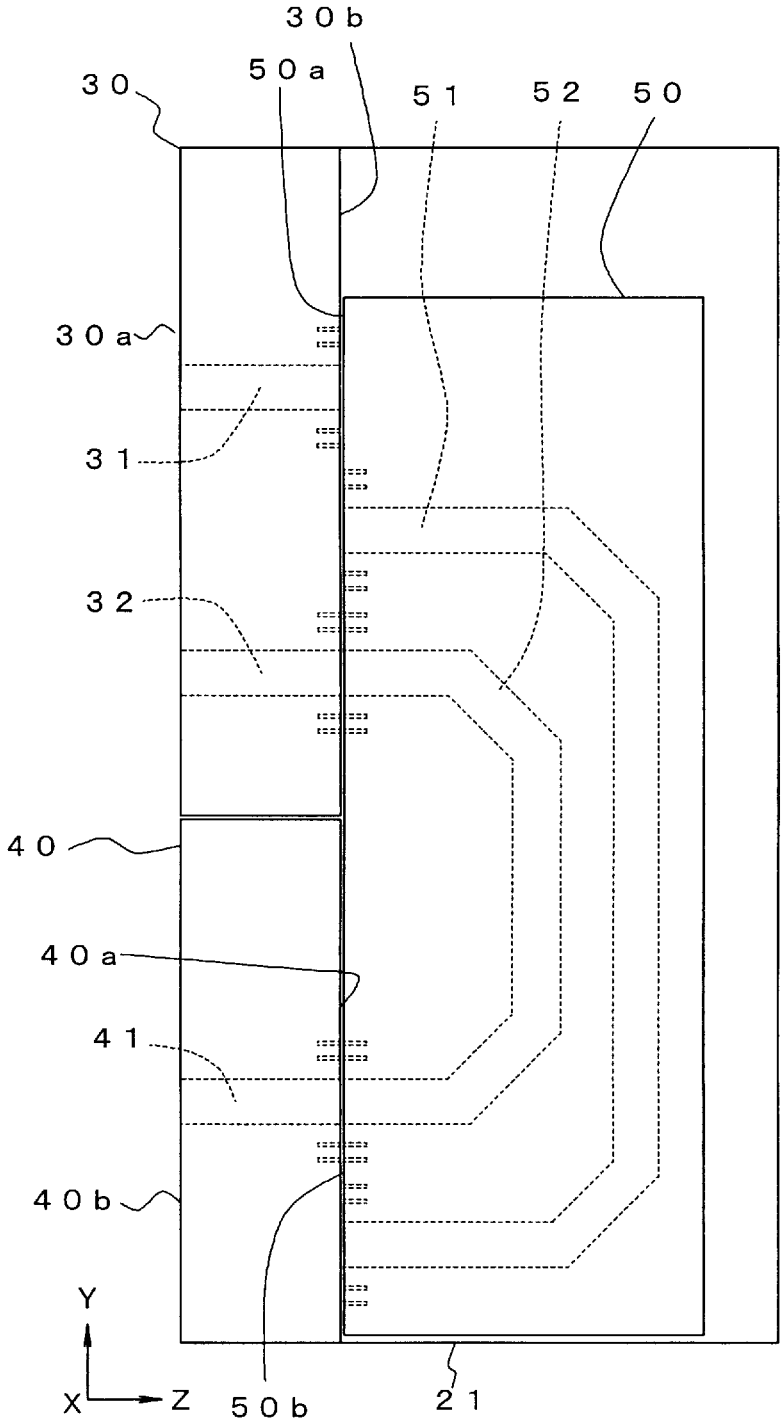
FIG. 20 is a view showing a switching operation of the structure example of FIG. 19.
Figure 21:
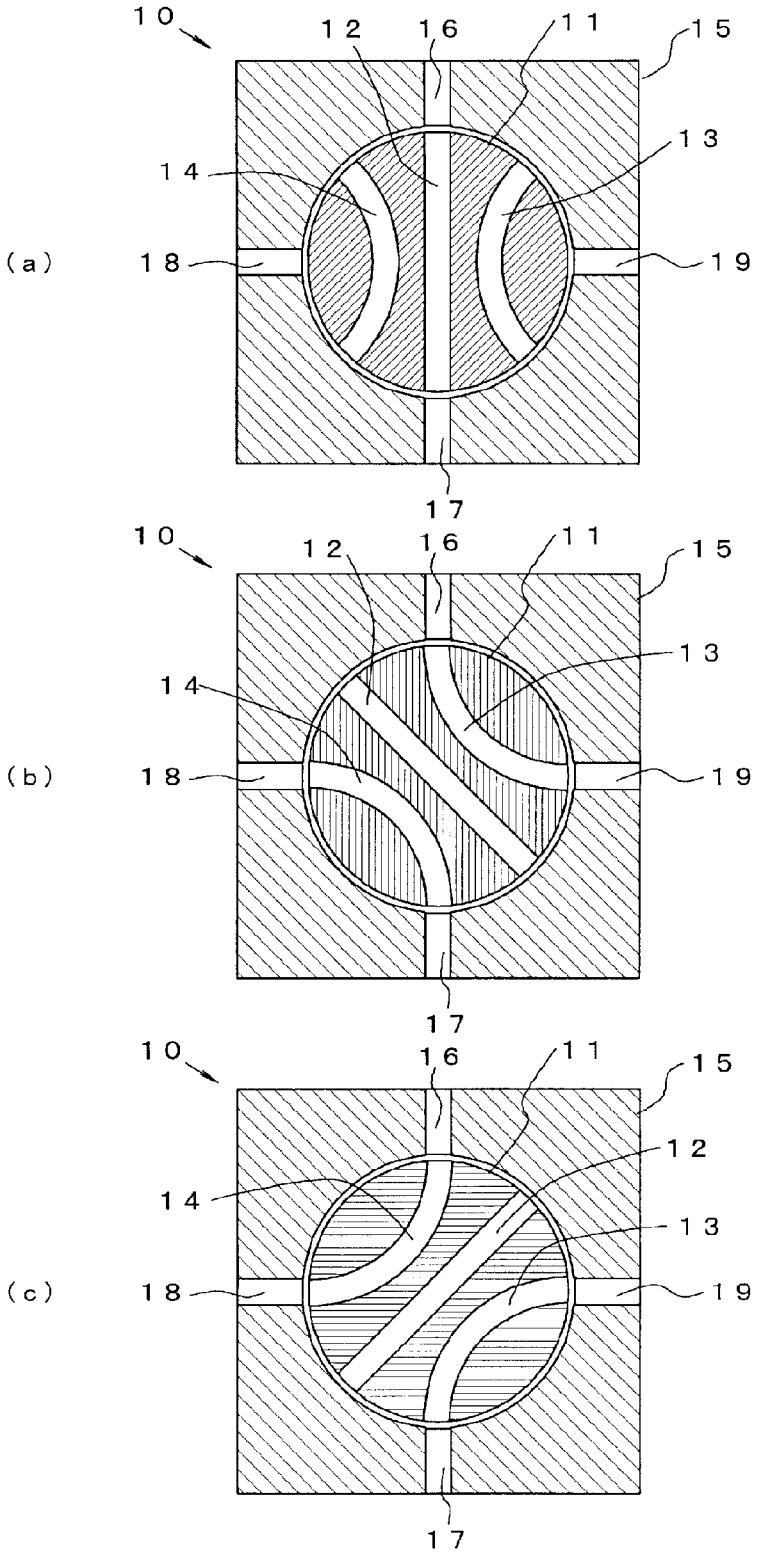
FIG. 21 PRIOR ART
FIG. 21 is a view showing a structure example of a device in the related art.

Moreover, in this structure example, when the movable waveguide block 50 is positioned at the position of FIG. 19 (first position), the transmission line 31 of the first fixing waveguide block 30 and the transmission line 41 of the second fixing waveguide block 40 are connected to each other via the transmission line 51 of the movable waveguide block 50, and if the movable waveguide block 50 slides from this state in the width direction (Y direction) by −L and is deviated to a position of FIG. 20 (second position), the transmission line 32 of the first fixing waveguide block 30 and the transmission line 41 of the second fixing waveguide block 40 are connected to each other via the transmission line 52 of the movable waveguide block 50.

Figure 18:
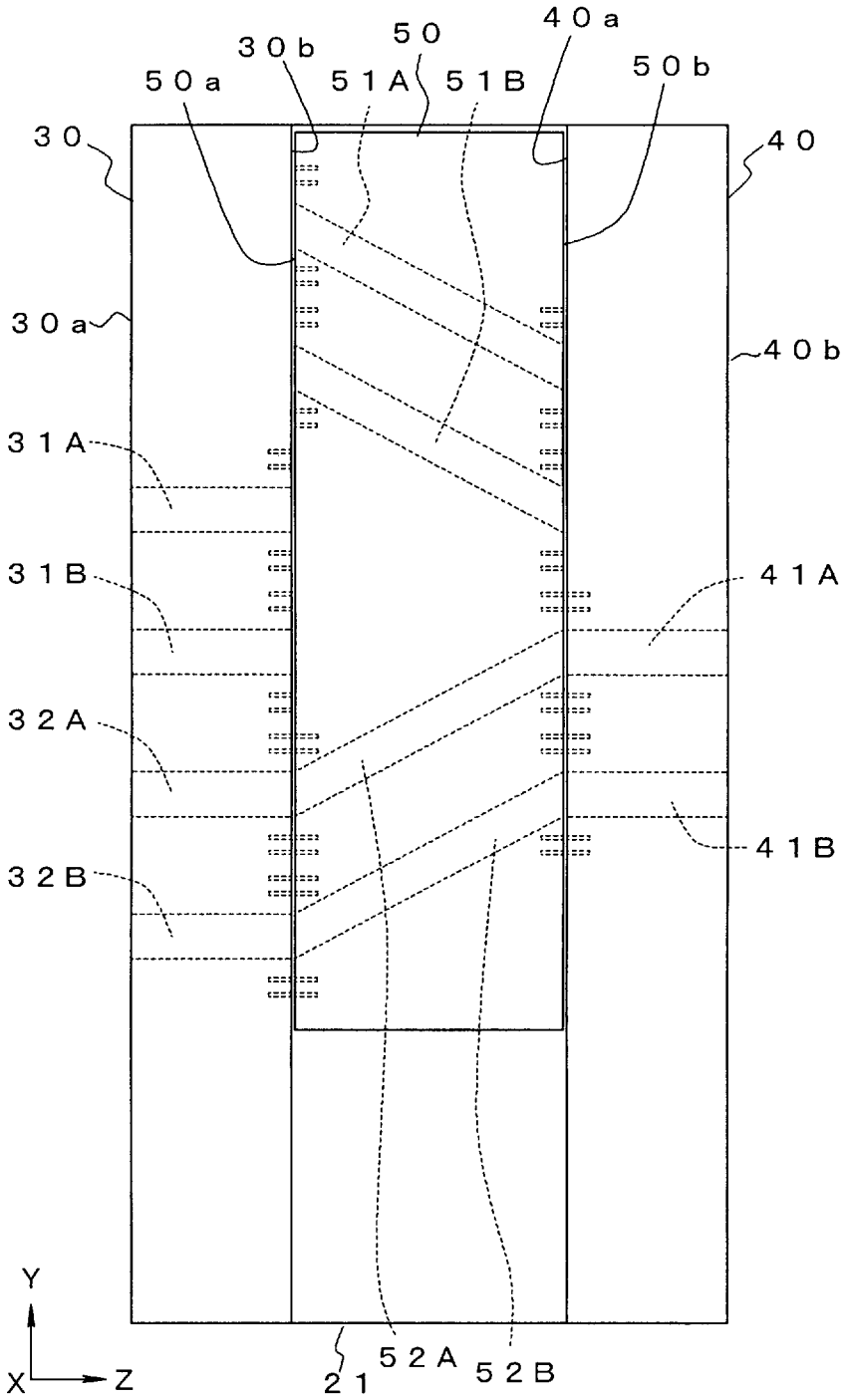
FIG. 18 is a view showing a switching operation of the structure example of FIG. 17.

Although it is not shown in the drawings, the structure example shown in FIGS. 18 and 19 may be a three-contact point type shown in FIGS. 14 to 16, and if the pairs of the transmission lines are provided in the structure example as shown in FIGS. 17 and 18, a two-circuit type may be realized.

In addition, in each embodiment, outlines of the fixing waveguide blocks 30 and 40 and the movable waveguide block 50 are formed in rectangular parallelepiped shapes. However, the outline of each waveguide block may be arbitrarily adopted and is not limited to the rectangular parallelepiped shape. In addition, two end surfaces formed on the openings of both ends of each transmission line are not limited to surfaces opposite to each other. That is, two end surfaces may be side surfaces adjacent to each other or may be combinations of the side surfaces and the upper surface. Moreover, the base portion 21 and the fixing waveguide blocks 30 and 40 may be formed so as to be integrated with each other.

In addition, even when reference numerals are omitted in each embodiment shown in FIGS. 14 to 20, as shown by dotted lines in each drawing, two grooves for preventing leakage of electromagnetic waves shown in FIGS. 1 to 5 are concentrically provided at the position surrounding the opening portion of one end side of each of the transmission lines 31 to 33, 31A, 31B, 32A, 32B, 41, 41A, and 41B, and the positions surrounding the opening portions of both ends of each of the transmission lines 51 to 53, 51A, 51B, 52A, and 52B. Accordingly, leakage of electromagnetic waves to the disconnected transmission lines is prevented.

DESCRIPTION OF REFERENCE NUMERALS AND SIGNS

20 . . . waveguide switch, 21 . . . base portion, 30 . . . first fixing waveguide block, 30*a* and 30*b* . . . end surface, 31 to 33, 31A, 31B, 32A, and 32B . . . transmission line, 35A, 35B, 36A, and 36B . . . groove, 40 . . . second fixing waveguide block, 40*a* and 40*b* . . . end surface, 41, 41A, and 41B . . . transmission line, 45A and 45B . . . groove, 50 . . . movable waveguide block, 50*a* and 50*b* . . . end surface, 51 to 53, 51A, 51B, 52A, and 52B . . . transmission line, 55A, 55B, 56A, 56B, 57A, 57B, 58A, and 58B . . . groove, 60 . . . drive device

What is claimed is:

1. A waveguide switch, comprising:

a base portion;

a first fixing waveguide block which is fixed to the base portion and in which a plurality of transmission lines surrounded by metal walls is formed to penetrate to a first end surface;

a second fixing waveguide block which is fixed to the base portion and has a second end surface parallel to the first end surface of the first fixing waveguide block, and in which a transmission line surrounded by metal walls is formed to penetrate from the second end surface; and a movable waveguide block which includes a third end surface which is parallel to and faces the first end surface of the first fixing waveguide block at a predetermined interval from the first end surface, a fourth end surface which is parallel to and faces the second end surface of the second fixing waveguide block at a predetermined interval from the second end surface, and a plurality of transmission lines surrounded by metal walls which are formed to penetrate from the third end surface to the fourth end surface, and which is supported by the base portion in a state where the movable waveguide block can slide in parallel to the first end surface of the first fixing waveguide block and the second end surface of the second fixing waveguide block due to a drive device, wherein grooves having a depth equivalent to ¼ of a guide wavelength of a leakage prevention object frequency are provided to prevent leakage of electromagnetic waves from a gap between the blocks at a position of a portion which surrounds each of openings of the plurality of transmission lines of the first fixing waveguide block on the first end surface side of the first fixing waveguide block, a position of a portion which surrounds an opening of the waveguide of the second fixing waveguide block on the second end surface side of the second fixing waveguide block, and a position of a portion which surrounds each of openings of the plurality of waveguides of the movable waveguide block on the third end surface side and the fourth end surface side of the movable waveguide block.

2. The waveguide switch according to claim 1, wherein the plurality of transmission lines of the first fixing waveguide block are formed to penetrate from a fifth end surface facing the first end surface toward the first end surface, wherein the transmission line of the second fixing waveguide block is formed to penetrate from the second end surface toward a sixth end surface facing the second end surface, wherein the drive device is provided in the base portion, and wherein the movable waveguide block is formed such that some of the plurality of transmission lines of the movable waveguide block connect some of the plurality of transmission lines of the first fixing waveguide block and the transmission line of the second fixing waveguide block when the movable waveguide block is positioned at a first position, and some other portions of the transmission lines of the movable waveguide block connect some other portions of the plurality of transmission lines of the first fixing waveguide block and the transmission line of the second fixing waveguide block when the movable waveguide block is positioned at a second position.

3. The waveguide switch according to claim 1, wherein the plurality of grooves are concentrically provided at predetermined intervals.

4. The waveguide switch according to claim 2, wherein the plurality of grooves are concentrically provided at predetermined intervals.

5. The waveguide switch according to claim 3, wherein a distance between the openings of the transmission lines of each of the first end surface side of the first fixing waveguide block, the second end surface side of the second fixing waveguide block, and the third end surface side and the fourth end surface side of the movable waveguide block and an inner groove is ¼ of a guide wavelength of a frequency in a region sufficiently lower than a lower limit of a transmission frequency region of the transmission line.

6. The waveguide switch according to claim 4, wherein a distance between the openings of the transmission lines of each of the first end surface side of the first fixing waveguide block, the second end surface side of the second fixing waveguide block, and the third end surface side and the fourth end surface side of the movable waveguide block and an inner groove is ¼ of a guide wavelength of a frequency in a region sufficiently lower than a lower limit of a transmission frequency region of the transmission line.

7. The waveguide switch according to claim 3, wherein a distance between an inner groove and an outer groove of each of the first end surface side of the first fixing waveguide block, the second end surface side of the second fixing waveguide block, and the third end surface side and the fourth end surface side of the movable waveguide block is ¼ of a guide wavelength of an odd number multiple of a transmission center frequency of the transmission line.

8. The waveguide switch according to claim 4, wherein a distance between an inner groove and an outer groove of each of the first end surface side of the first fixing waveguide block, the second end surface side of the second fixing waveguide block, and the third end surface side and the fourth end surface side of the movable waveguide block is ¼ of a guide wavelength of an odd number multiple of a transmission center frequency of the transmission line.

9. The waveguide switch according to claim 5, wherein a distance between an inner groove and an outer groove of each of the first end surface side of the first fixing waveguide block, the second end surface side of the second fixing waveguide block, and the third end surface side and the fourth end surface side of the movable waveguide block is ¼ of a guide wavelength of an odd number multiple of a transmission center frequency of the transmission line.

10. The waveguide switch according to claim 6, wherein a distance between an inner groove and an outer groove of each of the first end surface side of the first fixing waveguide block, the second end surface side of the second fixing waveguide block, and the third end surface side and the fourth end surface side of the movable waveguide block is ¼ of a guide wavelength of an odd number multiple of a transmission center frequency of the transmission line.

11. The waveguide switch according to claim 1, wherein an upper surface, a side surface, and a lower surface of the waveguide switch are covered with a metal case, and an upper surface and a side surface of the movable waveguide block are not in contact with an inner wall of the metal case.

12. The waveguide switch according to claim 2, wherein an upper surface, a side surface, and a lower surface of the waveguide switch are covered with a metal case, and an upper surface and a side surface of the movable waveguide block are not in contact with an inner wall of the metal case.

13. The waveguide switch according to claim 3, wherein an upper surface, a side surface, and a lower surface of the waveguide switch are covered with a metal case, and an upper surface and a side surface of the movable waveguide block are not in contact with an inner wall of the metal case.

14. The waveguide switch according to claim 4, wherein an upper surface, a side surface, and a lower surface of the waveguide switch are covered with a metal case, and an upper surface and a side surface of the movable waveguide block are not in contact with an inner wall of the metal case.

15. The waveguide switch according to claim 5, wherein an upper surface, a side surface, and a lower surface of the waveguide switch are covered with a metal case, and an upper surface and a side surface of the movable waveguide block are not in contact with an inner wall of the metal case.

16. The waveguide switch according to claim 6, wherein an upper surface, a side surface, and a lower surface of the waveguide switch are covered with a metal case, and an upper surface and a side surface of the movable waveguide block are not in contact with an inner wall of the metal case.

* * * * *